US006765338B2

(12) United States Patent
Orazietti

(10) Patent No.: US 6,765,338 B2
(45) Date of Patent: Jul. 20, 2004

(54) CHILD-RESISTANT PIEZOELECTRIC LIGHTER

(75) Inventor: Richard M. Orazietti, Derby, CT (US)

(73) Assignee: BIC Corporation, Milford, CT (US)

( * ) Notice: Subject to any disclaimer, the term of this patent is extended or adjusted under 35 U.S.C. 154(b) by 137 days.

(21) Appl. No.: 09/865,508

(22) Filed: May 29, 2001

(65) Prior Publication Data

US 2002/0180313 A1 Dec. 5, 2002

(51) Int. Cl.[7] ..... H01L 41/113
(52) U.S. Cl. ..... 310/339
(58) Field of Search ..... 310/339

(56) References Cited

U.S. PATENT DOCUMENTS

| | | | | |
|---|---|---|---|---|
| 3,457,461 A | | 7/1969 | Steinke et al. | 317/81 |
| 3,540,823 A | | 11/1970 | Ebine et al. | 431/255 |
| 3,734,680 A | | 5/1973 | Maruyama | 431/132 |
| 3,817,691 A | | 6/1974 | Tatsumi | 431/255 |

(List continued on next page.)

FOREIGN PATENT DOCUMENTS

| | | | | |
|---|---|---|---|---|
| JP | 6-249438 | | 9/1964 | F23Q/2/28 |
| JP | 60-89625 | | 5/1985 | F23Q/2/28 |
| JP | 05-66014 | | 3/1993 | |
| JP | 5-66014 | * | 3/1993 | 257/415 |
| JP | 11-63498 | * | 3/1999 | F23Q/2/16 |
| JP | 2001-343122 | | 12/2001 | F23Q/2/28 |
| JP | 2002-54814 | | 2/2002 | F23Q/2/28 |

*Primary Examiner*—Thomas M. Dougherty
(74) *Attorney, Agent, or Firm*—Jones Day

(57) ABSTRACT

A piezoelectric ignition mechanism includes an assembly having first and second members rotatable with respect to one another between an activated configuration and a deactivated configuration, a piezoelectric element associated with the assembly, and a plexor movably disposed in the assembly. When the assembly is in the activated configuration, the plexor is capable of being driven toward the piezoelectric element with sufficient force to impact the piezoelectric element and cause it to produce a spark.

33 Claims, 11 Drawing Sheets

U.S. PATENT DOCUMENTS

| | | | | | |
|---|---|---|---|---|---|
| 3,829,737 | A | | 8/1974 | Johnsson | 317/81 |
| 3,883,289 | A | | 5/1975 | Fujioka | 431/131 |
| 3,898,534 | A | | 8/1975 | Mohr | 317/81 |
| 4,608,508 | A | * | 8/1986 | Ohnishi | 310/339 |
| 4,626,731 | A | | 12/1986 | Sadoya | 310/339 |
| 4,758,152 | A | | 7/1988 | Kordecki | 431/153 |
| 4,830,603 | A | | 5/1989 | Cirami | 431/153 |
| 5,002,482 | A | | 3/1991 | Fairbanks et al. | 431/277 |
| 5,035,608 | A | | 7/1991 | Parren | 431/153 |
| 5,059,852 | A | | 10/1991 | Meury | 310/339 |
| 5,092,764 | A | | 3/1992 | McDonough et al. | 431/277 |
| 5,125,829 | A | | 6/1992 | McDonough et al. | 431/255 |
| 5,171,143 | A | | 12/1992 | Sohn | 431/153 |
| 5,178,532 | A | | 1/1993 | Frigiere | 431/254 |
| 5,215,458 | A | | 6/1993 | Cirami | 431/277 |
| 5,240,408 | A | | 8/1993 | Kenjiro et al. | 431/153 |
| 5,262,697 | A | | 11/1993 | Meury | 310/339 |
| 5,417,563 | A | | 5/1995 | Cirami | 431/153 |
| 5,417,571 | A | | 5/1995 | Kvalseth | 431/153 |
| 5,435,719 | A | | 7/1995 | McDonough et al. | 431/153 |
| 5,487,657 | A | | 1/1996 | Fairbanks et al. | 431/153 |
| 5,584,682 | A | | 12/1996 | McDonough et al. | 431/153 |
| 5,628,627 | A | | 5/1997 | Fairbanks et al. | 431/153 |
| 5,636,979 | A | | 6/1997 | McDonough et al. | 431/153 |
| 5,642,993 | A | | 7/1997 | McDonough et al. | 431/153 |
| 5,788,474 | A | | 8/1998 | Chung et al. | 431/153 |
| 5,854,530 | A | | 12/1998 | LaForest et al. | 310/339 |
| 5,927,962 | A | | 7/1999 | Amoros Nollas et al. | 431/255 |
| 5,980,239 | A | | 11/1999 | Doucet et al. | 431/153 |
| 6,010,328 | A | | 1/2000 | Sung | 431/153 |
| 6,045,354 | A | | 4/2000 | McDonough et al. | 431/153 |
| 6,046,528 | A | | 4/2000 | LaForest et al. | 310/339 |
| 6,065,958 | A | | 5/2000 | Adams et al. | 431/153 |
| 6,074,198 | A | | 6/2000 | Rogelet | 431/153 |
| 6,077,069 | A | | 6/2000 | Fairbanks et al. | 431/153 |
| 6,077,070 | A | | 6/2000 | Doucet et al. | 431/153 |
| 6,077,071 | A | | 6/2000 | Yeh | 431/153 |
| 6,086,358 | A | | 7/2000 | Potskhishvili et al. | 431/153 |
| 6,086,359 | A | | 7/2000 | Sher | 431/153 |
| 6,095,795 | A | | 8/2000 | Potskhishvili et al. | 431/153 |
| 6,095,796 | A | | 8/2000 | Sung | 431/153 |
| 6,099,296 | A | | 8/2000 | Wang | 431/153 |
| 6,099,297 | A | | 8/2000 | Chan | 431/153 |
| 6,099,298 | A | | 8/2000 | Potskhishvili et al. | 431/153 |
| 6,102,689 | A | | 8/2000 | Man | 431/153 |
| 6,106,277 | A | | 8/2000 | Xie | 431/153 |
| 6,116,892 | A | | 9/2000 | Yang | 431/153 |
| D437,732 | S | * | 2/2001 | Chevalier | D7/416 |
| 2002/0136996 | A1 | | 9/2002 | Ichikawa et al. | 431/153 |

* cited by examiner (Deactivated)

(Activated)

(Deactivated)

(Activated)

CHILD-RESISTANT PIEZOELECTRIC LIGHTER

FIELD OF THE INVENTION

The present invention relates to ignition mechanisms and devices containing such ignition mechanisms, such as, for example, lighters, including pocket and extended wand type lighters, disposable and non-disposable lighters, and, more particularly relates to piezoelectric ignition mechanisms and piezoelectric lighters, including particularly such ignition mechanisms and lighters that present increased resistance to operation by unintended users.

BACKGROUND OF THE INVENTION

Disposable gas lighters are available in a variety of forms. Typically, one common element of disposable lighters is an actuator pad or lever used to initiate the flow of fuel. An actuator pad is typically operated in conjunction with a spark producing mechanism so that the flow of fuel is ignited soon after it commences. For example, one type of lighter requires a user to rotate a toothed spark wheel against a flint in order to generate a spark, while, or immediately followed by, depressing the actuator pad to release gas and produce a flame.

Other means of ignition for disposable lighters employ a piezoelectric mechanism. In this type of ignition mechanism, a piezoelectric element, such as a crystal, is struck by a hammer in order to produce an electric spark. The spark is created at the fuel outlet or nozzle to ignite the gaseous fuel. The actuator button, upon forced depression by a user, typically commences both the flow of the fuel and then the ignition process. An example of such a piezoelectric ignition mechanism is disclosed in U.S. Pat. No. 5,262,697, entitled "Piezoelectric Mechanism For Gas Lighters."

Measures have been introduced to make activation of lighters more difficult or resistant to operation by unintended users. One typical method employed is to incorporate a latch member that inhibits depression of the actuator pad. Examples of such mechanisms are shown in U.S. Pat. Nos. 5,435,719; 5,584,682, and 5,636,979.

There remains, however, a need in the art for ignition mechanisms and lighters which increase the difficulty of inadvertent operation or undesirable operation by unintended users, and at the same time are user-friendly and appeal to a variety of intended users.

SUMMARY OF THE INVENTION

The present invention relates to a piezoelectric ignition mechanism which presents increased difficulty of operation by unintended users, and lighters, including pocket or extended wand type lighters that incorporate the same. In one embodiment, the ignition mechanism includes an assembly having first and second members which are slidable and rotatable with respect to one another about their common longitudinal axis. A piezoelectric element is positioned on the assembly, and a plexor is associated with, preferably located inside, the assembly. The assembly is rotatable between an activated and a deactivated configuration. When in the activated configuration, the plexor is capable of striking the piezoelectric element with sufficient force to produce a spark. Preferably, an impact spring is associated with one end of the plexor and is compressed by the plexor, the impact spring capable of driving the plexor, when in the activated position, with sufficient force to generate a spark. When in the deactivated configuration, the spring may not compress or be sufficiently compressed to drive the plexor toward the piezoelectric element to cause it to produce a spark.

The plexor preferably includes a lug disposed on its side that is received by a longitudinal slot defined on the first member. The first member may further have a notch associated with the longitudinal slot that is capable of receiving the lug. When the assembly is in the activated configuration, the lug may be moved into the notch and compressed against the impact spring. A window is defined in the second member and has a side portion. When the assembly is in the deactivated configuration, the side portion may contact the lug and block it from entering the notch. The window may further define a ramp portion, such that when the assembly is in the activated configuration and the first member is moved a predetermined distance toward the second member, the lug engages the ramp portion of the window, which rotates the plexor until the lug is released from the notch and is moveable within the longitudinal slot. More than one lug may be provided on the plexor, and more than one longitudinal slot and more than one notch may be provided in the first member. The second member also may have more than one window with more than one side and ramp portions.

In one embodiment, an abutment may be disposed on the first member and a cam may be disposed on the second member, wherein the cam is dimensioned to interact with the abutment when the first member is depressed toward the second member, such that the assembly is rotated to the deactivated configuration. Alternatively, the abutment may be disposed on the second member and the cam may be disposed on the first member. The abutment may be a portion of a push button associated with the first or second member.

In a further embodiment, the ignition mechanism includes an arm disposed on the second member for rotating it with respect to the first member, and the cam is disposed on the first member. The cam is dimensioned to bias the arm upon substantial depression of the first member such that the assembly is rotated to the deactivated configuration. Alternatively, the arm may be disposed on the second member and the cam may be disposed on the first member.

The present invention is also directed to a lighter incorporating the ignition mechanism. The ignition mechanism may be located in a lighter body having a fuel reservoir and which may have a valve for selectively releasing fuel. In one embodiment, the lighter body has an aperture defined therein, and an arm disposed on the ignition mechanism protrudes through the aperture to allow rotation of the first or second members therein with respect to one another.

The present invention is further directed to a utility lighter incorporating the ignition mechanism. The ignition mechanism may be located inside a housing having a handle, a fuel supply, and an extended wand having a nozzle for selectively releasing fuel. In one embodiment, an arm is connected to the ignition mechanism and the arm passes through an aperture provided in the housing. Rotation of the arm allows a user to rotate the first and second members with respect to one another within the housing, thus rotating the members between the activated and deactivated configurations. Preferably, the aperture is configured and dimensioned to bias the arm such that the plexor is automatically rotated to the deactivated configuration after the members are moved toward one another a predetermined distance.

BRIEF DESCRIPTION OF THE DRAWINGS

To facilitate an understanding of the characteristics, structure and operation of the invention, preferred features of the invention are described in the accompanying discussion, wherein similar reference characters denote similar elements throughout the several views or embodiments, and wherein.

DESCRIPTION OF THE PREFERRED EMBODIMENTS

Figure 1:
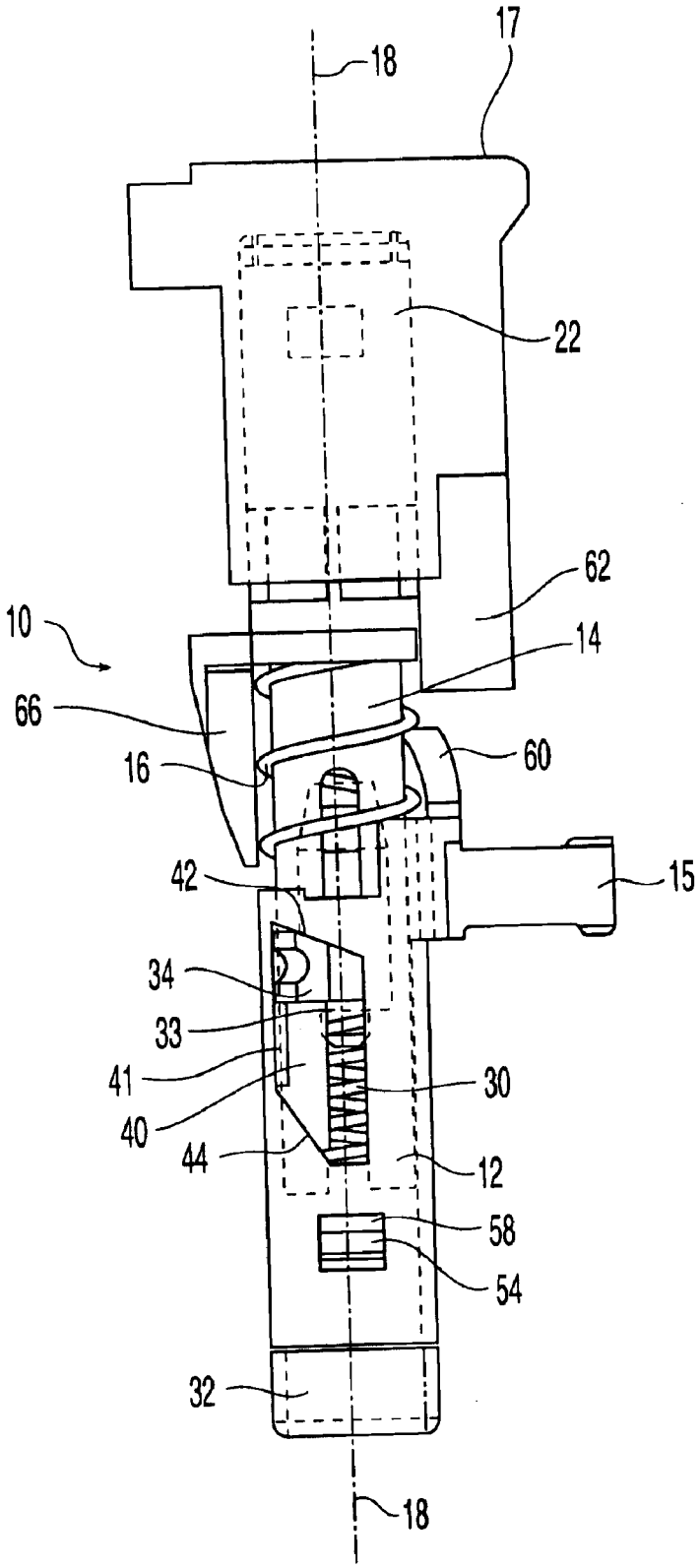
FIG. 1 is a front view of a piezoelectric ignition mechanism of the present invention, in the rest position and in the activated configuration.

Referring to the drawings, wherein like reference numbers are used to designate like parts, and wherein preferred features and embodiments of an ignition mechanism are shown for illustrative purposes and are not intended to limit the scope of the invention, FIG. 1 shows an embodiment of a piezoelectric ignition according to the present invention, shown as piezoelectric mechanism 10. Ignition mechanism 10 includes inner and outer telescopic members 12, 14 which are formed similar to concentric hollow tubes with inner member 14 being received in outer member 12. Inner member 14 is moveable relative to outer member 12 along longitudinal axis 18, and inner member 14 and outer member 12 are rotatable with respect to one another about their common longitudinal axis 18.

Arm 15 is formed on or may be attached to outer member 12 and provides a handle for rotating outer member 12 with respect to inner member 14. Alternatively, arm 15 could be formed on or attached to inner member 14. Return cam 60 may be formed on, attached to, or may otherwise be associated with outer member 12 and is dimensioned to interact with an abutment portion 62 of push button 17, or inner member 14, to automatically rotate outer member 12 with respect to inner member 14 upon a predetermined depression of inner member 14 into outer member 12. Alternatively, return cam 60 and abutment 62 may be configured on the inner and outer members respectively or vice versa to achieve the desired rotation, such as, for example, forming abutment 62 integrally on inner member 14, or placing return cam 60 on the inner member 14 and abutment 62 on the outer member 12. Return spring 16 is positioned between outer member 12 and the end of inner member 14 and biases the inner and outer members apart. Return spring 16 also overlies and is concentric with a portion of inner member 14. The inner and outer members may be constructed with a stop, lip or other means to prevent them from separating. Alternatively or additionally an external force may be applied to the members by, for example, a lighter body or housing, to maintain the inner and outer members together.

Figure 2:
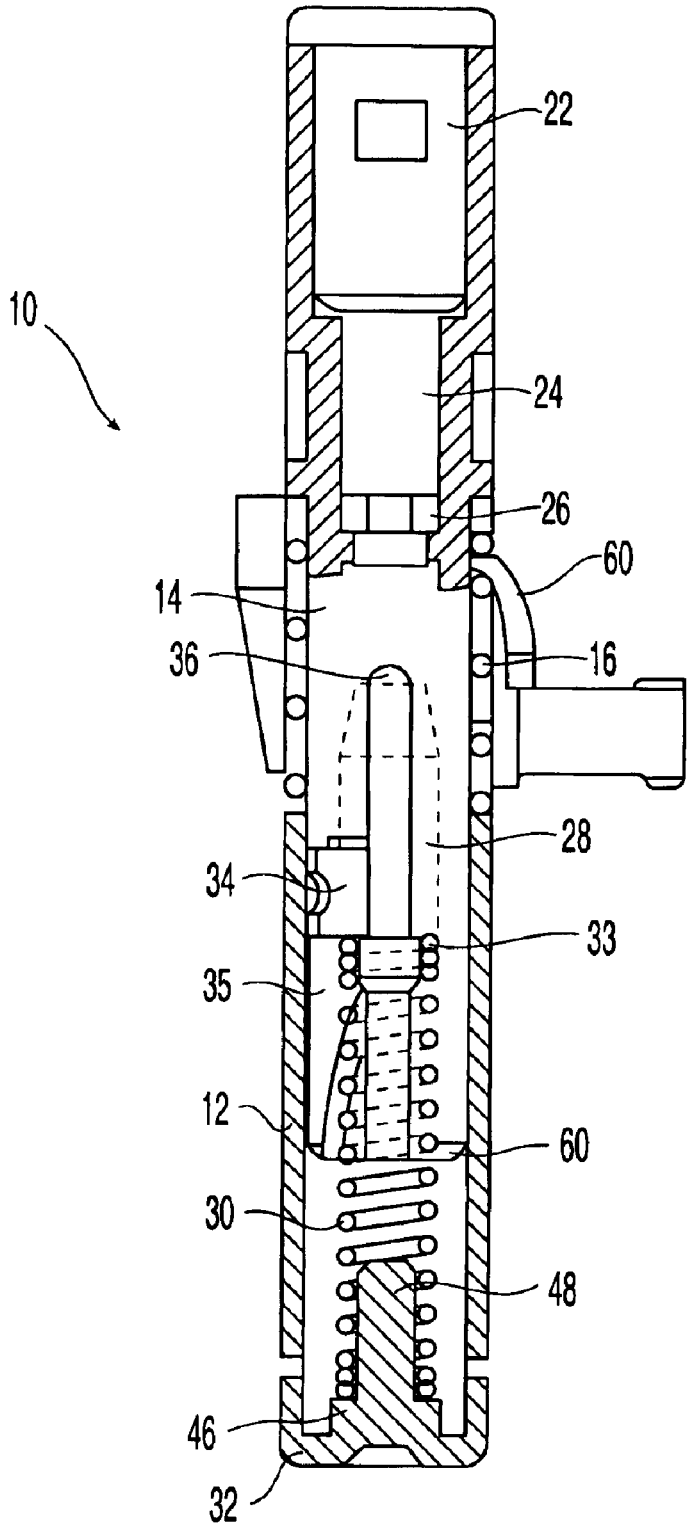
FIG. 2 is a partial cross-sectional view of the ignition mechanism of FIG. 1.

As shown in FIG. 2, anvil member 22 is attached to the end of inner member 14 and maintains both piezoelectric element 24 and impact pad 26 inside inner member 14. Anvil member 22 is preferably attached to inner member with cooperating tabs and grooves, alternatively or additionally by other means of attachment, such as screws, cooperating screw threads, pins, welding or glue, may be used. Alternatively, anvil member 22 may be integrally formed with inner member 14. Impact pad 26 is located adjacent piezoelectric element 24 and transfers impact energy from impact pad 26 directly to the piezoelectric element 24. Thus, anvil 22, piezoelectric element 24 and impact pad 26 are all part of an electrical circuit and cooperate to produce a spark when impact pad 26 is struck by plexor member 28 with sufficient force, as will be discussed in more detail below.

Figure 3:
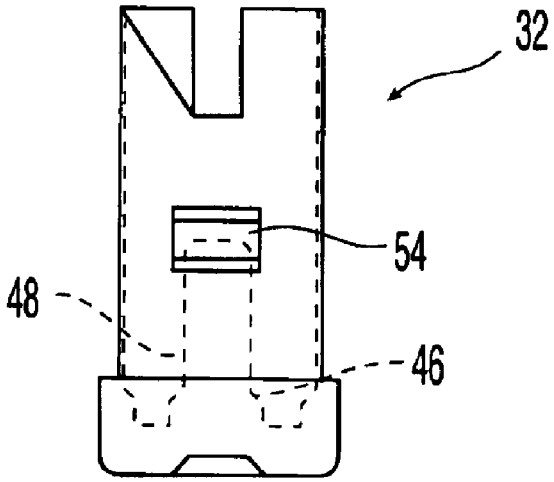
FIGS. 3 and 4 are respective front and side views of an end cap for the outer member of the piezoelectric mechanism of FIG. 1.
Figure 4:
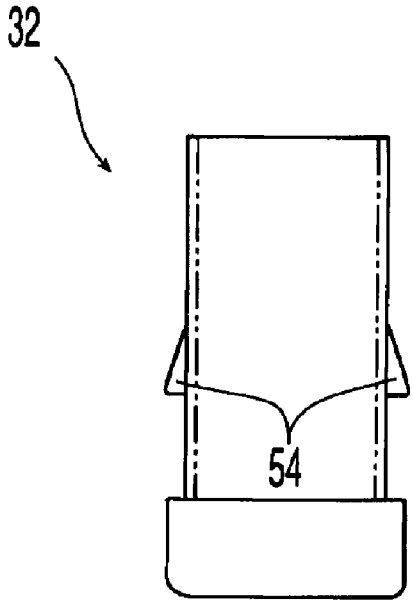

Referring to FIGS. 3 and 4, end member 32 is located on one end of outer member 12 and has hooks 54 disposed on opposite sides thereof that engage with openings 58 on outer member 12 to retain end member 32 in outer member 12. Other methods of fastening known in the art, such as glueing, welding, screwing or pinning, could also be used to retain end member 32 in outer member 12, or end member 32 may be integrally formed with outer member 12. As shown in FIGS. 2 and 3, end member 32 has boss 48 and ledge 46 to retain one end of impact spring 30.

Figure 5:
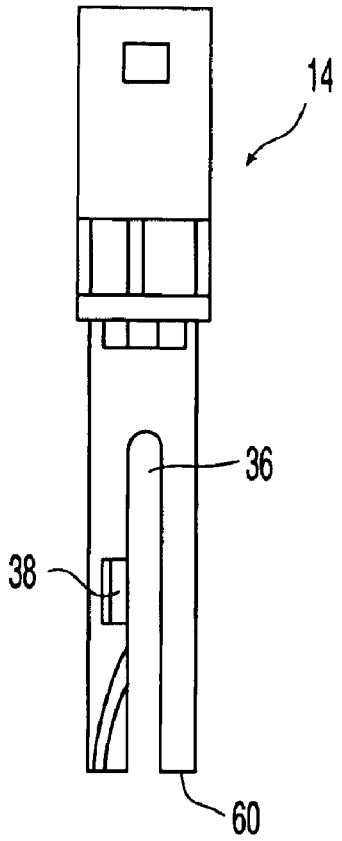
FIG. 5 is a front view of an inner member of the ignition mechanism of FIG. 1.
Figure 6:
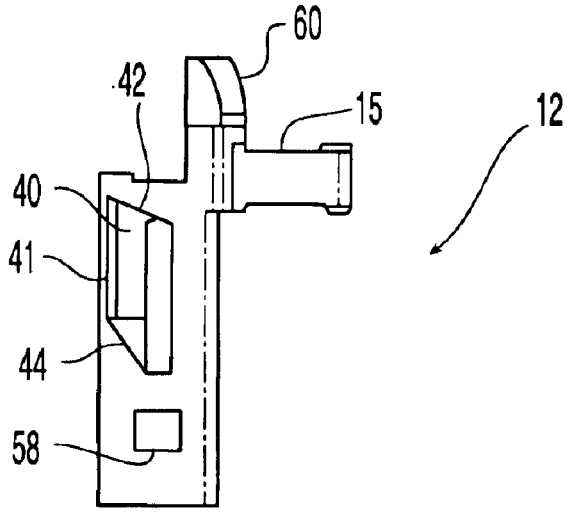
FIG. 6 is a front view of an outer member of the ignition mechanism of FIG. 1.
Figure 7:
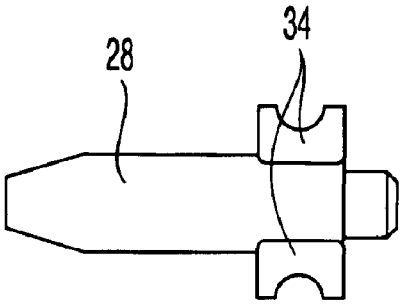
FIG. 7 is a front view of a plexor element of FIG. 1.
Figure 8:
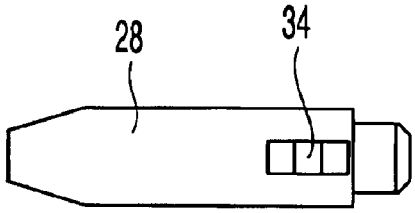
FIG. 8 is a side view of the plexor element of FIG. 1.

Plexor member 28, shown in phantom in FIG. 2, is located within inner member 14. Plexor member 28 can move longitudinally within the hollow passageway 35 of inner member 14 along axis 18. As shown in detail in FIGS. 7 and 8, plexor 28 is generally cylindrical with a blunt end and has two lugs 34 formed on opposite sides thereof. Although plexor 28 has been shown and described as cylindrical, it may be configured to have any overall shape that will allow it to slide and rotate in inner member 14. Lugs 34 are received in longitudinal slots 36, which are defined on opposite sides of inner member 14 as shown in FIG. 5. Longitudinal slots 36 guide the movement of plexor 28, substantially limiting its movement to the longitudinal direction. Each longitudinal slot 36 has a retaining notch 38. The plexor 28 may rotate so that the lugs 34 rotate from the slots 36 to the retaining notches 38, and vice versa. Lugs 34 are configured and dimensioned to protrude beyond slots 36 and into windows 40, which are defined on opposite sides of outer member 12 as shown in FIGS. 1 and 6.

Windows 40 each have an upper ramp surface 42 and a lower ramp surface 44 and side surfaces. Thus, the displacement and movement of lugs 34 is confined by slots 36, notches 38, and windows 40. Impact spring 30 is positioned inside outer member 12 and is associated at one end with, and preferably retained at one end by, end member 32. The other end 33 of impact spring 30 is associated with, and more preferably retains, one end of plexor 28. Impact spring 30 biases plexor 28 toward upper ramp surfaces 42, which bias the lugs 34 toward the left edge 41 of windows 40.

To increase the difficulty of operation by unintended users, the ignition mechanism may be switched between a deactivated configuration and an activated configuration. In the deactivated configuration, shown in FIG. 9A, the ignition mechanism 10 can not be operated to create an electric spark. Conversely, in the activated configuration, shown in FIGS. 1, 2, 9B, the ignition mechanism 10 may be operated to create an electric spark. The ignition mechanism is preferably configured so that after it fires, the mechanism returns to the deactivated configuration. In the case of ignition mechanism 10, the deactivated configuration is shown in FIG. 9A where the lugs 34 are rotated so that they contact the left edge 41 of windows 40 and are blocked from entering notches 38.

Figure 9A:
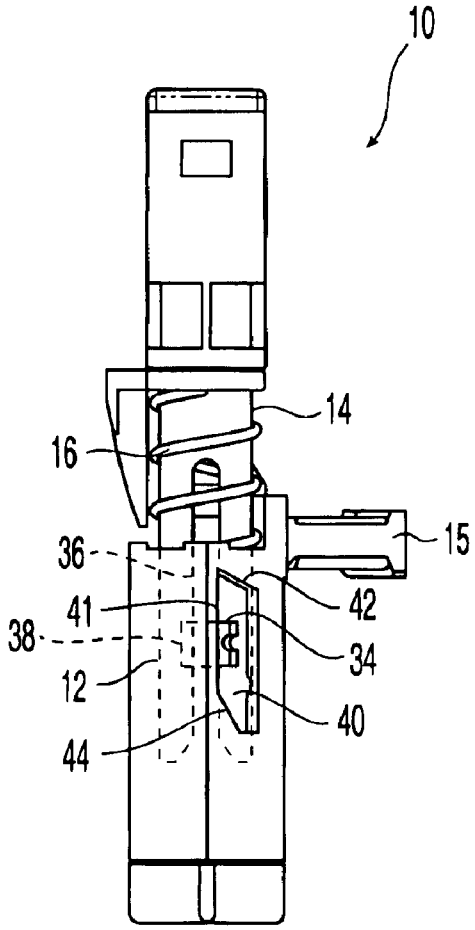
FIG. 9A is a front view of the ignition mechanism of FIG. 1 with portions in phantom, in the rest position and in the deactivated configuration.

When in the deactivated configuration shown in FIG. 9A, notches 38 are located beyond the left edges 41 of windows 40 and contact between lugs 34 and left edges 41 blocks lugs 34 from entering into notches 38. In this configuration, upon depression of push button 17, lugs 34 slide freely in slots 36 and the plexor 28 is not compressed against impact spring 30. As a result, insufficient energy is stored in impact spring 30 to cause the plexor 28 to fire at impact pad 26 with enough force to contact impact pad 26 and create an electrical potential across piezoelectric element 24.

Figure 10A:
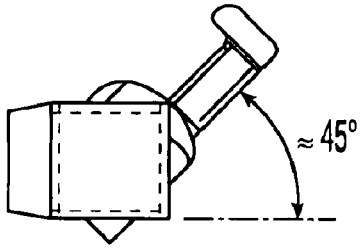
FIG. 10A is a top view of the ignition mechanism of FIG. 9A.
Figure 10B:
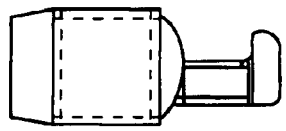
FIG. 10B is a top view of the ignition mechanism of FIG. 9B.

The ignition mechanism 10 may be switched between the deactivated and activated configurations by rotation of inner member 14 and outer member 12 with respect to one another about their common longitudinal axis 18. This rotation causes outer member 12 to be rotated approximately 45° with respect to inner member 14, so that edge 41 no longer prevents the lugs 34 from entering notches 38. Alternatively, plexor 28 may be rotated directly such that lugs 34 are located out of notches 38. The angle of rotation between the activated and deactivated positions is preferably about 45°, as indicated in FIG. 10A, but, as appreciated by one of ordinary skill in the art, may be configured and adapted to require more or less respective rotation.

To switch from the deactivated to the activated configuration, the user rotates the outer member 12 counter-clockwise about 45° with respect to the inner member 14 by rotating arm 15. Rotation of outer member 12 imparts rotation to the plexor 28 and/or lugs 34 so that as outer member 12 is rotated counter-clockwise, notches 38 are uncovered and lugs 34 move from the longitudinal slots 36 into notches 38 and remain there. More specifically, lugs 34 are pushed into the notches 38 and held there by upper ramp surfaces 42 as outer member 12 is rotated. Alternatively, and as discussed above, plexor 28 may be rotated directly with an arm or other protrusion formed thereon such that lugs 34 are pushed into notches 38. As a result of the lugs 36 being engaged in notches 38, any depression of inner member 14 toward outer member 12 displaces plexor 28 and thereby compresses impact spring 30 and stores energy therein. Thus, in the activated configuration, the plexor 28 maybe compressed against the impact spring 30 and the ignition mechanism 10 is readied to be actuated.

Figure 9B:
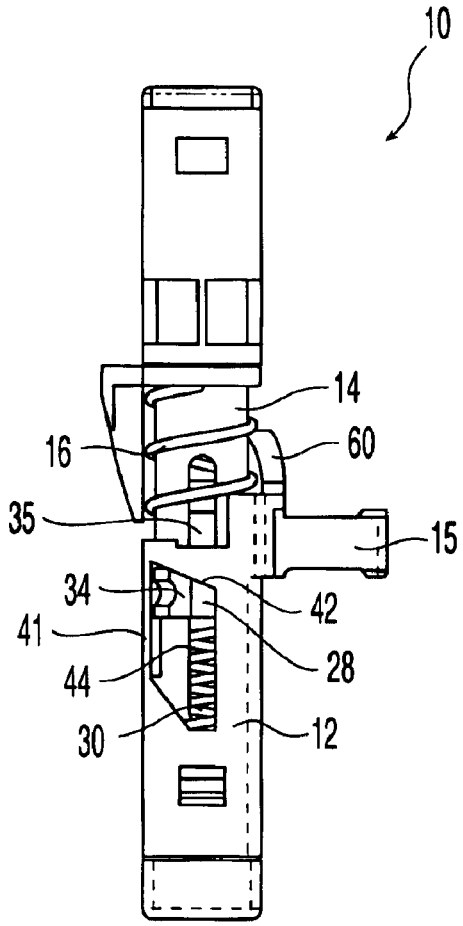
FIG. 9B is a front view of the ignition mechanism of FIG. 1, in the rest position and, in the activated configuration.
Figure 11:
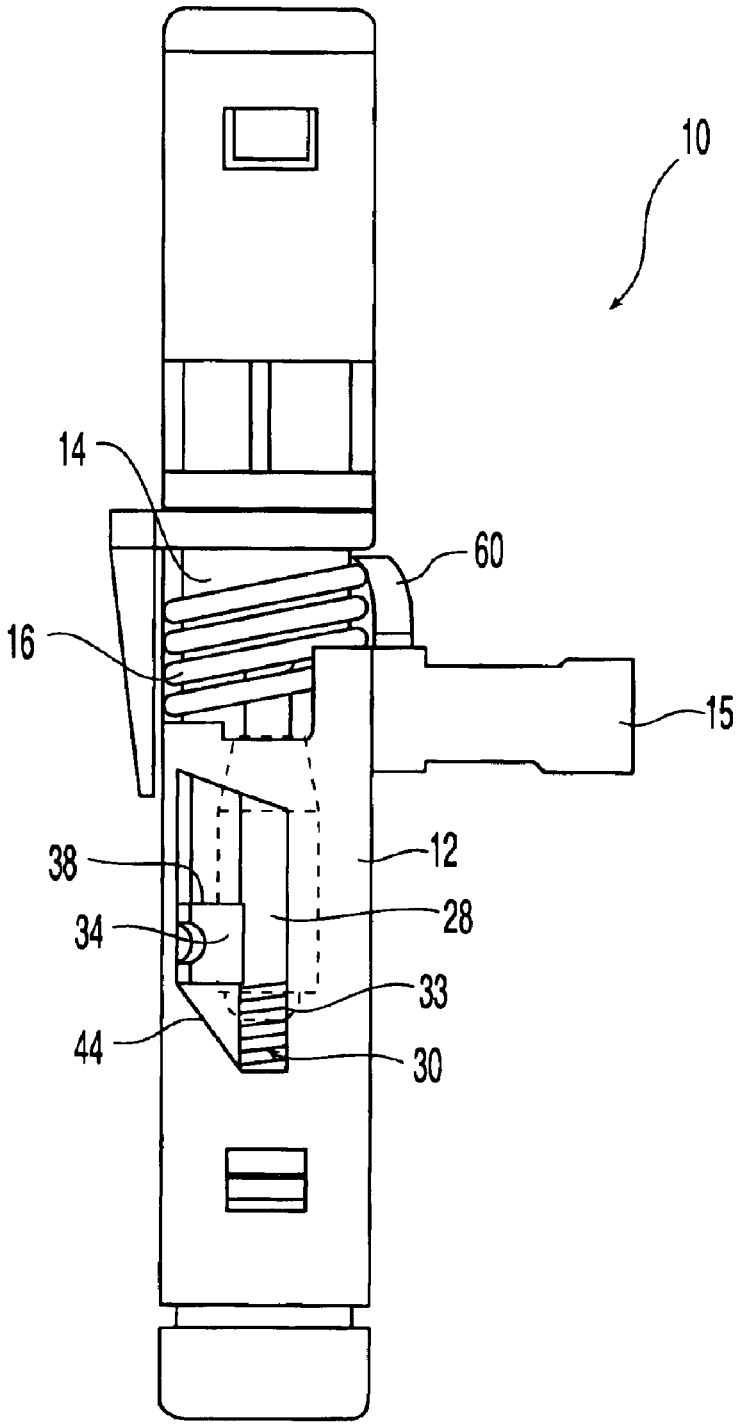
FIG. 11 is a front view of the ignition mechanism of FIG. 1 showing partial compression of the impact spring.
Figure 12:
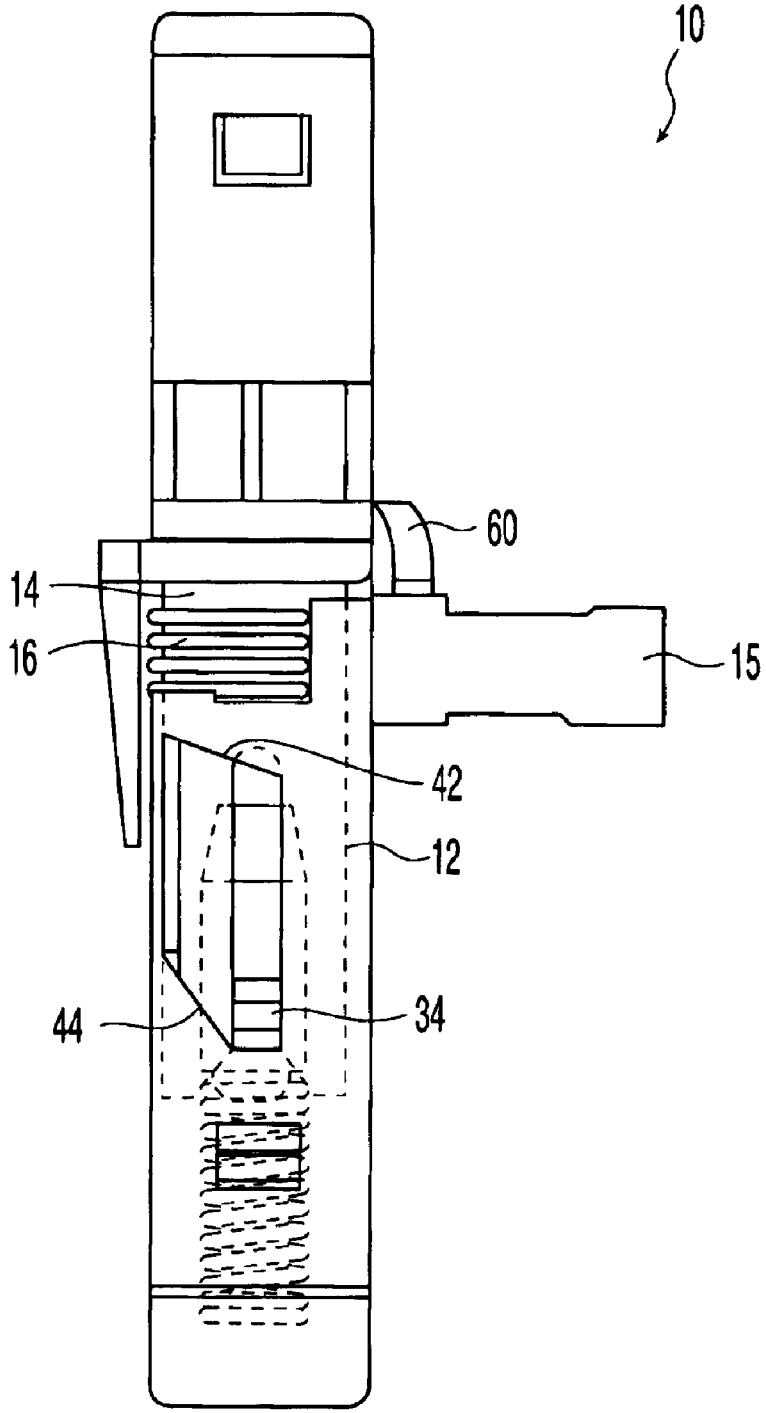
FIG. 12 a front view of the ignition mechanism of FIG. 1 showing full compression of the impact spring just before activation.

FIGS. 1, 2 and 9B show the ignition mechanism 10 in the rest position while in the activated configuration. Lugs 34 of plexor member 28 are held in notches 38 on the inner member 14 and the movement of the plexor 28 is thereby coordinated with the movement of inner member 14. Thus, when inner member 14 is depressed into the outer member 12, plexor member 28 slides in hollow passageway 35 and depresses impact spring 30, thereby storing energy in the spring. When the inner member 14 is depressed a predetermined distance into outer member 12, lugs 34 contact the top of lower ramp surfaces 44, as shown in FIG. 11. At this point, continued depression of inner member 14 further compresses impact spring 30 and also pushes lugs 34 of plexor 28 along ramp surface 44 causing plexor 28 and lugs 34 to rotate. This rotation causes lugs 34 to move out of notches 38 (for example, see FIG. 12). After lugs 34 are fully released from notches 38, plexor member 28 is immediately driven by compressed impact spring 30 toward impact pad 26. The impact spring 30 pushes the plexor 28 toward the impact pad 26 and the lugs 34 travel in longitudinal slots 36 until the plexor 28 strikes impact pad 26 to transfer the energy from the plexor 28 to piezoelectric element 24, thereby exciting piezoelectric element 24 to create an electrical potential across the piezoelectric element.

Figure 13:
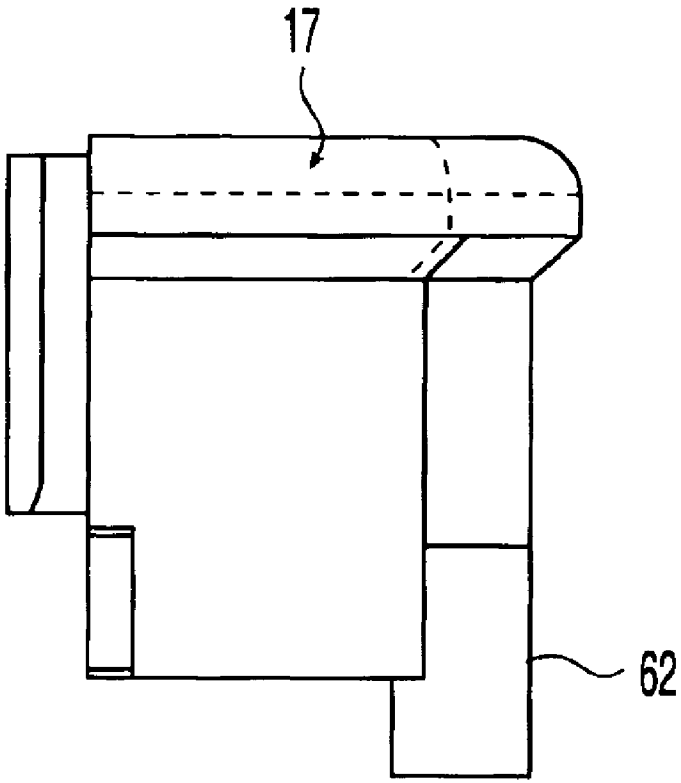
FIG. 13 is a front view of a push button element of FIG. 1.

After lugs 34 are released from notches 38 causing the ignition mechanism 10 to fire, return cam 60, disposed on outer member 12, contacts abutment 62 on push button 17 (shown in FIGS. 1 and 13) and causes the outer member 12 to rotate back to the deactivated configuration, discussed above and shown in FIG. 9A. Alternatively, abutment 62 may be associated with inner member 14, and alternatively return cam 60 and abutment 62 may be on inner and outer members respectively as a person of ordinary skill in the art can readily appreciate. This cam action is intended to return the ignition mechanism to the deactivated configuration after the ignition mechanism 10 has been actuated. In a further alternative embodiment, return cam 60 can be disposed on the push button 17 and dimensioned to interact with arm 15 to cause the rotation of the outer member 12. In yet another embodiment, the cam and the abutment can be disposed on the outer and inner members in various arrangements to rotate the outer member 12 back to the deactivated position.

After the ignition mechanism 10 has been actuated, the user can release the inner and/or outer members thereby allowing the compressed return spring 16 to expand and return the inner and outer telescopic members to the fully extended, or "rest" position. As mentioned above, the interaction between return cam 60 and push button 17 has caused the ignition mechanism 10 to return to the deactivated configuration and the plexor 28 cannot be actuated to create an electric potential across piezoelectric element 24. Because the deactivated configuration is the default or rest configuration for ignition mechanism 10, the mechanism provides some measure of resistance to operation by unintended users and resists inadvertent operation.

Figure 14:
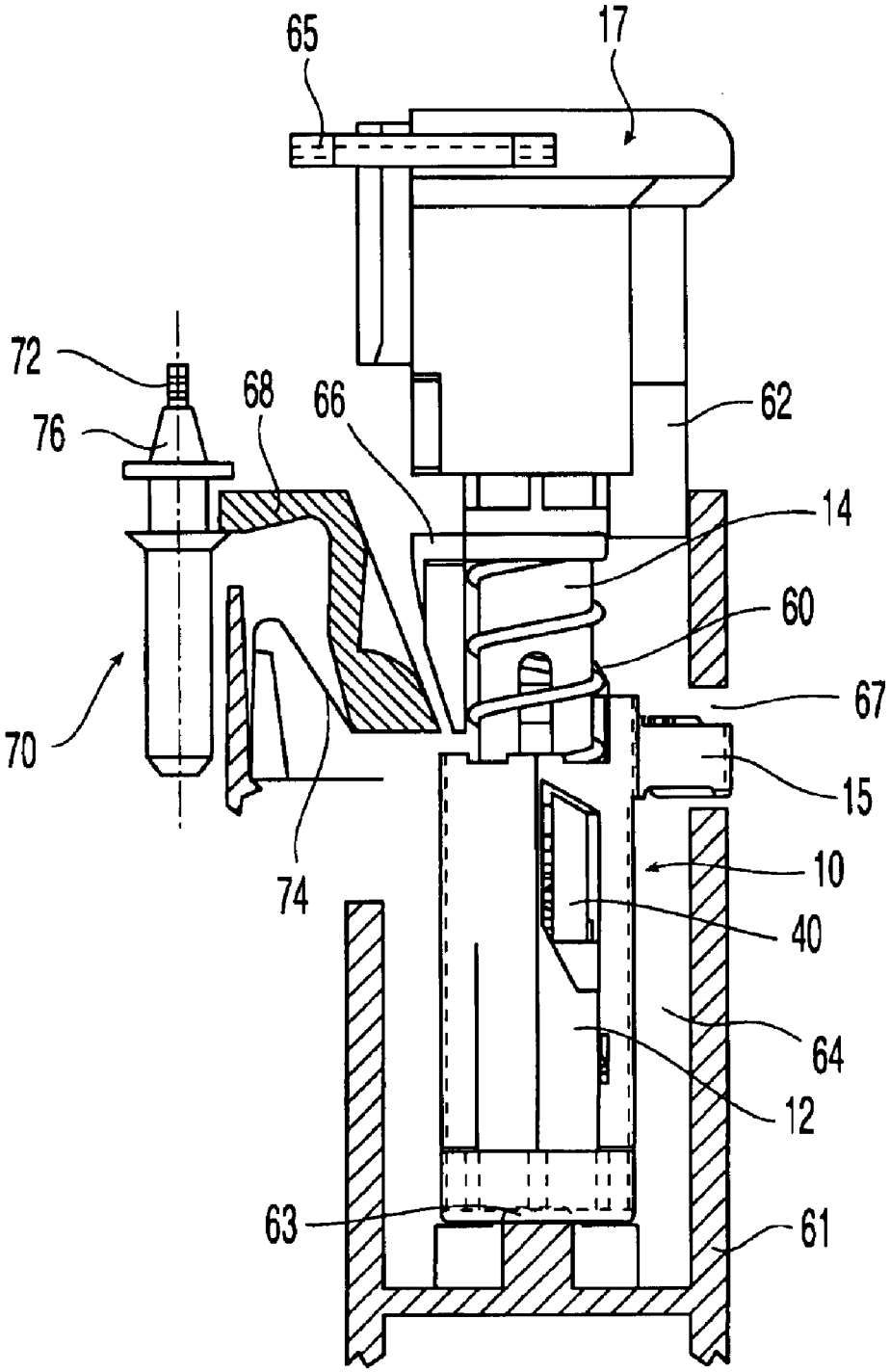
FIG. 14 is a front view, in partial cross-section, of the piezoelectric mechanism of FIG. 1 located in a lighter assembly and in the rest position and deactivated configuration.

FIG. 14 shows a partial cross-sectional view of an illustrative embodiment of a pocket lighter incorporating ignition mechanism 10. Ignition mechanism 10 is disposed within a chamber 64 inside a lighter body 61. Inner member 14 is held from rotating by push button 17 and outer member 12 may rotate within chamber 64. Outer member 12 may optionally be supported at one end by pivot mount 63. Arm 15 protrudes through slot 67 in the lighter body 61 and allows the user to rotate outer member 12 in the chamber 64 to permit the user to switch the lighter between the deactivated and activated configurations.

After the user successfully enables and activates ignition mechanism 10, and plexor 28 strikes impact pad 26, which transfers the impact energy to the piezoelectric element 24, an electrical potential difference is created across piezoelectric element 24. The potential difference is transferred to create an electrical discharge between electrodes 65 and 72 to discharge a spark to ignite released fuel. In particular, an electrical circuit is created wherein the following elements are connected in series: first electrode 65, anvil 22, piezoelectric member 24, impact pad 26, cam member 66, valve actuator 68, valve 70 and second electrode or nozzle 72. For example, piezoelectric element 24 may be in electrical contact with anvil 22 and first electrode 65; and piezoelectric element 24 may also be in electrical contact with cam member 66, valve actuator 68, valve 70, and nozzle 72, which acts as a second electrode 72. Thus, the potential difference across piezoelectric element 24 is conducted through this circuit, and creates substantially the same potential difference between first electrode 65 and second electrode 72. This potential difference is sufficient to discharge a spark across the air gap between the two electrodes. In other words, the two electrodes act similar to a capacitor with dielectric disposed therebetween. Any electrically conductive material may be utilized to make the components of this circuit and a person of ordinary skill in the art would appreciate and would be able to select suitable materials for the various components in this circuit.

After arm 15 is rotated to the activated configuration and push button 17 is depressed to actuate ignition mechanism 10, cam member 66 is also depressed and acts on valve actuator 68. Valve actuator 68 is pivoted such that when cam member 66 pushes one end of valve actuator 68 downward, the other end is moved upward thereby lifting valve 70 (partially shown in FIG. 14) to release fuel gas. The released gas is then ignited by the spark discharged between electrodes 65 and 72 when the push button is depressed enough to activate the ignition mechanism 10. In the embodiment illustrated in FIG. 14, the first electrode 65 moves with respect to the second electrode 72 and, more particularly, moves closer to the second electrode 72 so that the gap over which the spark is discharged decreases as the push button 17 is depressed to create a spark. One skilled in the art can appreciate that the first electrode may be fixed and/or the distance between the electrodes can remain fixed.

As the button 17 is depressed further, abutment 62 on push button 17 contacts return cam 60 (partially hidden in FIG. 14) on the outer member 12 and rotates the outer member 12 to the deactivated configuration.

Valve actuator 68 controls the movement of valve 70 to release fuel from the fuel supply. In the embodiment shown in FIG. 14, the fuel supply is compressed hydrocarbon gas and valve 70 is a normally open valve, forced closed by the pressure of a valve spring 74. In this embodiment, valve actuator 68 lifts valve stem 76 upward to release the compressed hydrocarbon gas. In another embodiment, valve 70 may be a normally closed valve and valve actuator 68 moves valve stem 76 to open the valve 70 and release the compressed hydrocarbon gas.

To operate the lighter, the user pushes arm 15 to rotate the outer housing 12 to the activated configuration. The user then depresses push button 17, which causes cam member 66 to engage valve actuator 68 to lift valve stem 76 to release fuel gas. This depression also causes plexor 28 to compress impact spring 30 and to eventually be released from notches 38. Upon release from notches 38, compressed impact spring 30 drives plexor 28 against impact pad 26 and causes piezoelectric element 24 to produce a spark across electrodes 65 and 72 to ignite the released fuel to produce a flame. As discussed above, contact between abutment 62 and return cam 60 causes the lighter to return to the deactivated configuration shown in FIG. 9A. To extinguish the flame, the user simply releases push button 17 thereby releasing valve actuator 68 allowing valve spring 74 to close valve 70.

Figure 15:
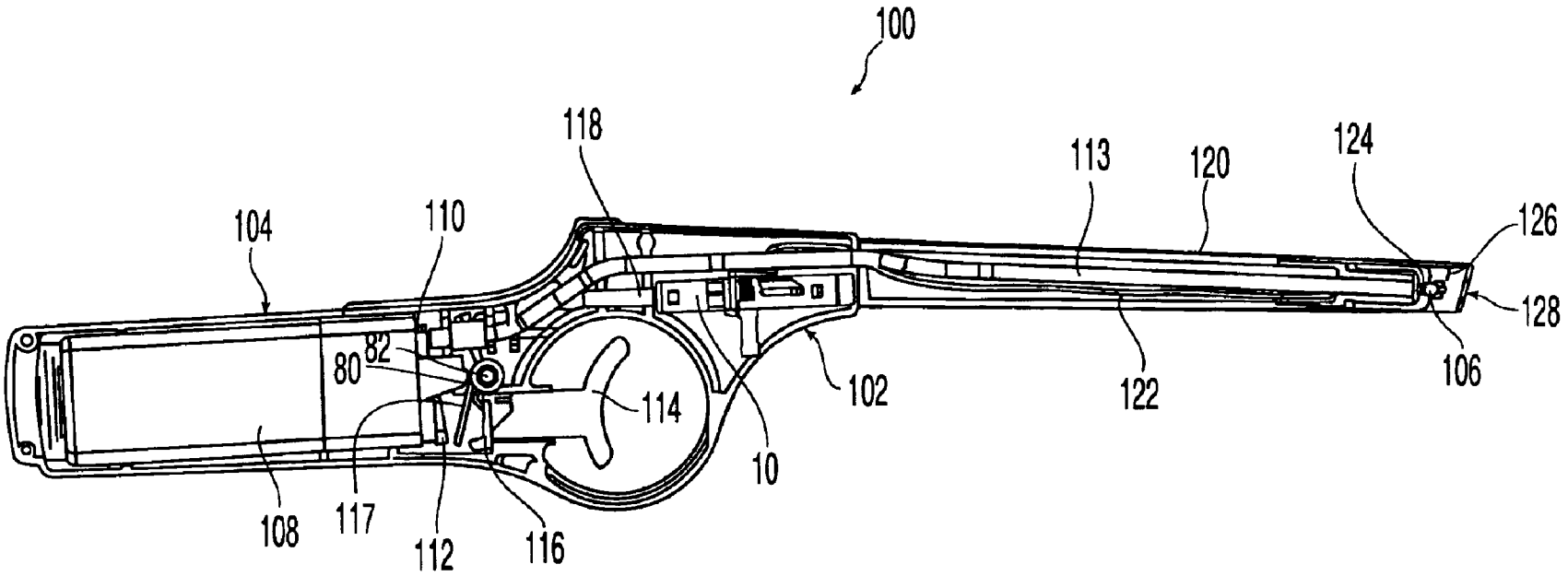
FIG. 15 is a side elevational view of a utility lighter incorporating the ignition mechanism of FIG. 1, showing the utility lighter with portions removed.

FIG. 15 is a side elevational view of an illustrative embodiment of a utility lighter 100 incorporating the ignition mechanism 10. The utility lighter 100, shown in FIG. 15, has portions removed to show various inner components. Utility lighter 100 generally includes a housing 102 which includes a handle 104 and a nozzle 106. Nozzle 106 is disposed away from the handle 104 in an extended wand or rod and is for emitting fuel to feed a flame, as will be described herein. Handle 104 preferably contains a fuel source 108 which selectively supplies fuel to nozzle 106, preferably via a valve 110 on the fuel supply container 108. Valve 110 preferably is operated by an actuating assembly which may include a valve actuator 112, which is pivotally attached to fuel source 108. Thus, when valve actuator 112 is depressed, fuel is released by valve 110 and flows through a conduit, such as a flexible tube 113, to nozzle 106.

The actuating assembly further may include other components to facilitate depression of the valve actuator 112 and may simultaneously activate piezoelectric ignition mechanism 10 to generate a spark proximate nozzle 106. The actuating assembly preferably comprises a trigger member 114, a pivoting member 116, and a linking rod 118 operatively connected to ignition mechanism 10. A spring 117 may be located between the pivoting member 116 and valve actuator 112. One skilled in the art will appreciate that other actuating mechanisms and assemblies may be utilized to selectively release fuel or to activate the ignition mechanism. One skilled in the art can further appreciate that the actuating assembly to release fuel may comprise a single component or multiple components and may include a pivoting valve actuator and separate user-contact member such as, for example, trigger 114. One skilled in the art also can appreciate that a gas release member separate from an ignition activating member may be provided such as shown in U.S. patent application Ser. No. 09/393,653, the disclosure of which is incorporated by reference.

Outer member 12 of ignition mechanism 10 is associated with linking rod 118 and may rotate in lighter housing 102. According to one embodiment, a recess is formed in end member 32 of outer member 12 and a protrusion is formed on linking rod 118 such that end member 32 (not shown in FIG. 15) may rotate about the protrusion. This configuration allows ignition mechanism 10 to be more easily switched between the deactivated and activated configurations.

Ignition mechanism 10 is part of an electrical circuit. In the illustrative embodiment shown in FIG. 15, piezoelectric element 24 (not shown in FIG. 15) is in electrical connection with wand 120, which is made of an electrically conductive material. A tab 126 is preferably stamped from wand 120 proximate nozzle 106. Piezoelectric element 24 is also in connection with insulated wire 122, which has an exposed end 124 that contacts nozzle 106. Thus, nozzle 106 acts as a first electrode in the circuit, and tab 126 acts as a second electrode in the circuit, with a spark gap between the two electrodes. Upon activation of ignition mechanism 10, an electrical potential is created between nozzle 106 and tab 126, which potential is sufficient to discharge a spark across the spark gap. An opening 128 maybe provided at the end of wand 120 to allow passage of a flame from the utility lighter 100. Any electrically conductive material may be utilized to make the components of this circuit. A person of ordinary skill in the art would appreciate and be able to select suitable materials for the various components in this circuit.

Figure 16:
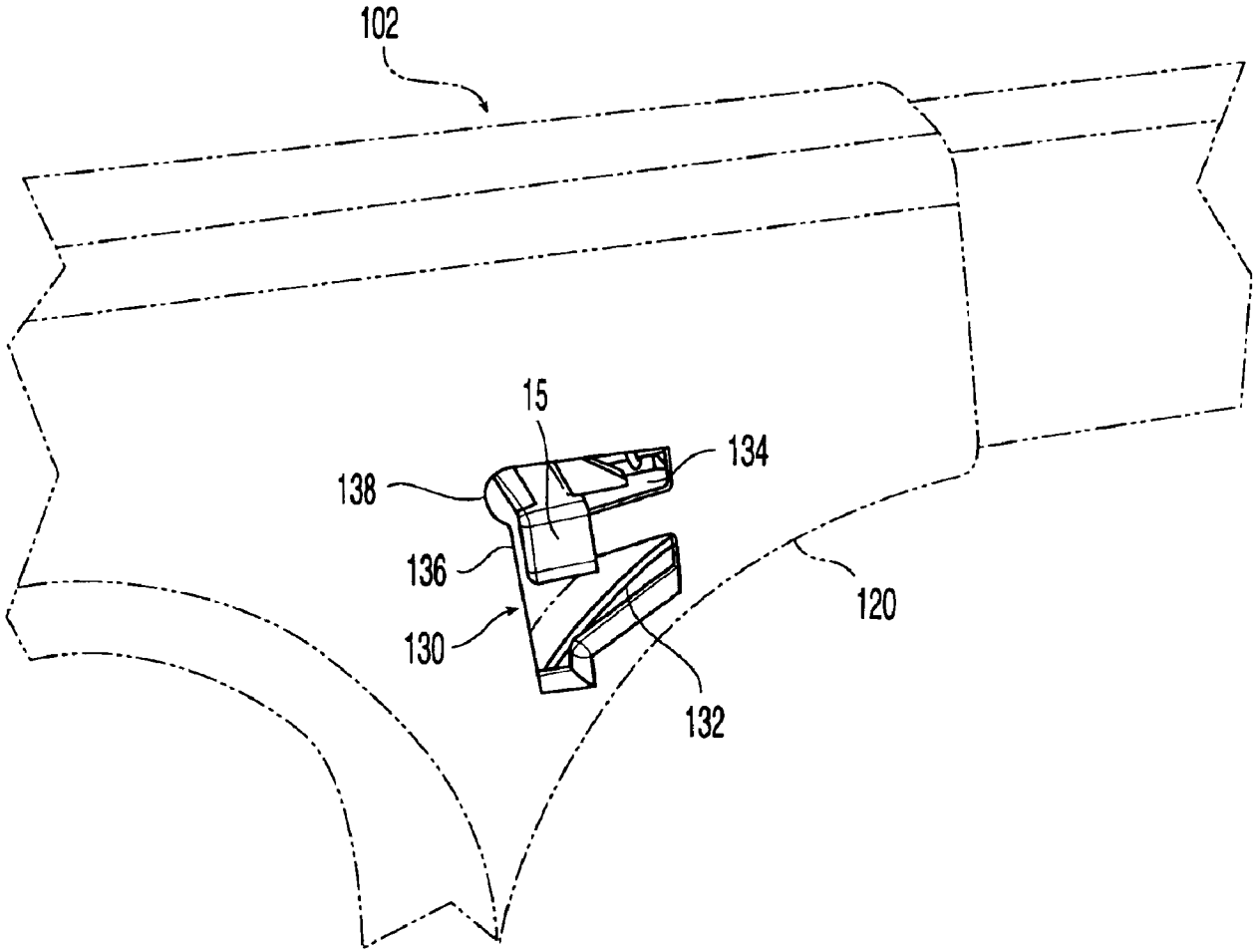
FIG. 16 is a partial side perspective view of the utility lighter of FIG. 15.

As shown in FIG. 16, an aperture 130 is formed in the lighter housing 102 and allows passage of arm 15 of the ignition mechanism 10, described above, therethrough. In this embodiment, aperture 130 is substantially U-shaped and is configured such that arm 15 may align with a first slot 132 when the ignition mechanism 10 is in the deactivated configuration, and arm may 15 align with a second slot 134, as shown in FIG. 16, when ignition mechanism 10 is moved into the activated configuration. Biasing edge 136 of the aperture 130 preferably is slanted to align arm 15 with the first slot 132 when arm 15 is urged against it so that after every use of the lighter 100 the ignition mechanism 10 preferably automatically returns to the deactivated configuration. Thus, after the user fires the utility lighter 100 and releases trigger 114, the outer member 12 of the ignition mechanism 10 extends away from the inner member 14, under the force of return spring 16, and thereby causes arm 15 to contact and slide along biasing edge 136, causing the outer member 12 to rotate to the deactivated configuration. Preferably, a small pocket 138 may be formed in the upper-left portion of biasing edge 136 to hold arm 15 in alignment with the second slot 134 when the arm 15 is first moved into the activated position.

In alternate embodiments, various configurations of a cam and abutment may be disposed on ignition mechanism 10 to automatically return ignition mechanism 10 to the deactivated configuration after every firing. One embodiment may feature a cam located on inner member 14 to interact with arm 15, and another may feature an abutment located on inner member 14 to interact with a cam located on outer member 12. Alternatively or additionally, inner and outer members 14, 12 can be configured to automatically rotate with respect to one another to the deactivated configuration. For example, return spring 16 may also act as a torsion spring when outer member 12 is rotated to the activated configuration such that upon activation of the lighter 100, return spring 16 unwinds and rotates outer member 12 back to the deactivated configuration.

To use the utility lighter 100, the user must first enable the ignition mechanism 10 by moving arm 15 upwardly. This rotates outer housing 12 counterclockwise inside lighter housing 102 and places ignition mechanism 10 in the activated configuration, as discussed above.

The user next pulls trigger member 114, which causes valve actuator 112 to release fuel from fuel source 108. Gaseous fuel, such as butane, or other hydrocarbon, is thereby released from nozzle 106. At approximately the same time, the actuation of trigger 114 rotates pivoting member 116 in a clockwise direction against linking rod 118 and thereby compresses and fires ignition mechanism 10 to generate a potential difference between nozzle 106 and tab 126. A spark is thereby generated in the spark gap between nozzle 106 and tab 126 and ignites the air/gas mixture in the vicinity of nozzle 106. The resulting flame passes through opening 128 in shell 120.

When the user releases pressure from trigger member 114, valve actuator 112 closes in order to shut off the supply of fuel to nozzle 106. This extinguishes the flame emitted from opening 128. At the same time, return spring 16 and/or impact spring 30 aids separation of inner member 14 and outer member 14 of the ignition mechanism. This separation or movement causes arm 15 to move in slot 134 in the lighter housing 120 toward biasing edge 136. Once arm 15 contacts biasing edge 136, continued pressure on arm 15, created by return spring 16 aids arm 15 in sliding down along inclined surface of biasing edge 136, which rotates the outer member 12 until ignition mechanism 10 is returned to the deactivated configuration.

The piezoelectric ignition mechanism of the present invention may also be incorporated into a natural gas oven range, an outdoor gas grill or similar devices to increase the degree of difficulty of operation and, therefore, its level of resistance to inadvertent operation or undesirable operation by unintended users.

While preferred embodiments and features of the ignition mechanism and lighters using the ignition mechanism have been disclosed herein, it will be appreciated that numerous modifications and embodiments may be devised by those skilled in the art. It is intended that the appended claims cover all such modifications and embodiments as fall within the true spirit and scope of such claims and that the claims not be limited to or by such preferred embodiments or features.

What is claimed:

1. A piezoelectric ignition mechanism comprising:

an assembly having first and second members rotatable with respect to one another between an activated configuration and a deactivated configuration;

a piezoelectric element associated with the assembly; and a plexor movably associated with the assembly;

wherein when the assembly is in the activated configuration, the plexor is capable of being driven toward the piezoelectric element with sufficient force to impact the piezoelectric element and cause it to produce a spark.

2. The piezoelectric ignition mechanism of claim 1, wherein:

the assembly defines a longitudinal axis;

the first and second members are slidable with respect to one another along the longitudinal axis; and the first and second members rotate with respect to one another about the longitudinal axis between the activated and deactivated configurations.

3. The piezoelectric ignition mechanism of claim 1, further comprising an impact spring having first and second ends, the first end associated with the plexor, wherein the impact spring is capable of being compressed in the activated configuration to drive the plexor toward the piezoelectric unit with sufficient force to cause the piezoelectric element to produce a spark.

4. The ignition mechanism of claim 3, wherein when the assembly is in the deactivated configuration, the impact spring cannot be sufficiently compressed to cause the impact spring to drive the plexor toward the piezoelectric element with sufficient force to impact the piezoelectric element and cause it to produce a spark.

5. The ignition mechanism of claim 1, wherein the plexor includes at least one lug disposed on its side, and the assembly has at least one longitudinal slot adapted and configured to receive the lug and control movement of the plexor.

6. The ignition mechanism of claim 5, wherein the assembly further defines at least one notch, and when the assembly is in the activated configuration, the at least one lug is receivable in the at least one notch.

7. The ignition mechanism of claim 6, wherein when the assembly is in the deactivated configuration, the at least one lug is prevented from entering the at least one notch.

8. The ignition mechanism of claim 6, wherein the at least one longitudinal slot and the at least one notch are defined in the first member and connected.

9. The ignition mechanism of claim 8, wherein the second member has at least one window adapted and configured such that when the assembly is in the deactivated configuration, a side portion of the window contacts the at least one lug and prevents the at least one lug from entering the at east one notch.

10. The ignition mechanism of claim 9, wherein the at least one window further defines a ramp portion, such that when the assembly is in the activated configuration and the first member is moved a predetermined distance toward the second member, the at least one ramp causes the at least one lug to move out of the at least one notch.

11. The ignition mechanism of claim 1, further comprising a cam disposed on one of the members, wherein the cam is adapted and configured to interact with at least a portion of the other member and rotate the first member with respect to the second member.

12. The ignition mechanism of claim 11, further comprising a push button located on one of the members, the push button having an abutment extending therefrom, wherein the portion of the first member is the abutment.

13. The ignition mechanism of claim 11, wherein the cam is disposed on the first member and the cam is dimensioned to interact with an arm disposed on the second member.

14. The ignition mechanism of claim 1, used in a lighter.

15. The ignition mechanism of claim 1, used in a utility lighter having an extended wand.

16. A lighter comprising:

a lighter body having a fuel reservoir and an actuator for selectively releasing fuel; and a piezoelectric ignition mechanism for igniting the released fuel comprising:

an assembly having first and second members rotatable with respect to one another between an activated configuration and a deactivated configuration;

a piezoelectric element positioned on the assembly;

a plexor movably disposed in the assembly; and a biasing element associated with the plexor;

wherein when the assembly is in the activated configuration, the plexor is capable of being driven by the biasing element toward the piezoelectric element with sufficient force to produce a spark.

17. The lighter of claim 16, wherein at least one of the first and second members is rotatable inside the lighter body.

18. The lighter of claim 16, further comprising a cam disposed on one of the members, wherein the cam is adapted and configured to interact with at least a portion of the other member to rotate the first member with respect to the second member.

19. The ignition mechanism of claim 18, further comprising a push button located on the first member and having an abutment extending therefrom, wherein the cam is disposed on the second member interacts with the abutment.

20. The ignition mechanism of claim 16, further comprising:

an arm disposed on one of the members for rotating the member and an aperture in the lighter body, wherein at least a portion of the arm extends through the aperture.

21. The lighter of claim 16 having a handle, a wand extending from the handle and a nozzle in the wand for releasing fuel.

22. A utility lighter comprising:

a housing having a handle, a fuel supply, a wand extending away from the handle, a nozzle, and an actuator for selectively releasing fuel to the nozzle; and a piezoelectric ignition mechanism for igniting the released fuel which comprises:

an assembly having first and second members rotatable with respect to one another between an activated configuration and a deactivated configuration;

a piezoelectric element positioned on the assembly; and a plexor movably disposed in the assembly;

wherein when the assembly is in the activated configuration the plexor is capable of being driven toward the piezoelectric element with sufficient force to impact the piezoelectric element and cause it to produce a spark and ignite the released fuel.

23. The utility lighter of claim 22, wherein one of the first and second members is rotatable inside the housing.

24. The lighter of claim 22, further comprising an aperture in the housing and an arm disposed on the second member and adapted and configured to rotate the second member, wherein at least a portion of the arm extends through the aperture.

25. The lighter of claim 24, wherein the aperture is adapted and configured to bias the arm such the the assembly is returned to the deactivated configuration after the first and second members return to the rest position after activating the piezoelectric ignition mechanism.

26. The lighter of claim 25, wherein the aperture is substantially U-shaped with a slanted ramp for biasing the arm to a deactivated configuration.

27. The lighter of claim 22, further comprising an impact spring associated with the plexor.

28. A piezoelectric ignition mechanism comprising:

an assembly movable between an activated configuration and a deactivated configuration;

a piezoelectric element associated with the assembly; and a plexor associated with the assembly, the plexor including at least one lug for engaging the assembly when the assembly is in the activated configuration, so that the plexor may be moved by the assembly to compress a biasing element;

wherein when the assembly is in the deactivated configuration, the at least one lug is blocked from engaging the assembly.

29. the piezoelectric ignition mechanism of claim 28, wherein the assembly includes first and second members.

30. the piezoelectric ignition mechanism of claim 29, wherein the first and second members rotate with respect to one another between the activated and deactivated configurations.

31. the piezoelectric ignition mechanism of claim 29, wherein when the assembly is in the activated configuration, the at least one lug engages a notch on one of the first and second members, and when the assembly is in the deactivated configuration, the at least one lug is blocked from engaging the notch by the other of the first and second members.

32. the piezoelectric ignition mechanism of claim 29, wherein the assembly defines a longitudinal axis, and compressing the first and second members with respect to one another along the longitudinal axis causes the plexor to compress the biasing element.

33. the piezoelectric ignition mechanism of claim 32, wherein when the first and body members the compressed towards one another a predetermined distance, the at least one lug is disengaged from the assembly causing the biasing element to drive the plexor towards the piezoelectric element to create a spark.

* * * * *